United States Patent [19]

Green

[11] 4,353,665

[45] Oct. 12, 1982

[54] DELINEATOR

[76] Inventor: Helen Green, Box 156, Gildford, Mont. 59525

[21] Appl. No.: 124,447

[22] Filed: Feb. 25, 1980

[51] Int. Cl.[3] ..... E01F 9/01

[52] U.S. Cl. ..... 404/10; 248/145; 248/289.3; 248/475 B

[58] Field of Search ..... 404/10; 256/13.1; 40/612; 248/548, 549, 475 B, 145, 289.3, 300

[56] References Cited

U.S. PATENT DOCUMENTS

| | | | |
|---|---|---|---|
| 1,508,052 | 9/1924 | Hastings | 248/145 |
| 1,632,726 | 6/1927 | Conklin | 248/300 X |
| 1,759,314 | 5/1930 | Kinquist | 248/289.3 |
| 2,050,573 | 8/1936 | Kammerich | 248/145 |
| 2,280,476 | 4/1942 | Calvert | 248/145 |
| 2,445,606 | 7/1948 | Davis | 248/300 X |
| 2,562,021 | 7/1951 | Dotten | 248/145 |
| 2,931,611 | 4/1960 | Watson | 248/289.3 X |
| 2,976,000 | 3/1961 | Gunderson | 248/204 |
| 3,367,613 | 2/1968 | Christensen | 248/145 |
| 3,658,284 | 4/1972 | Haasl | 248/145 |
| 4,032,248 | 6/1977 | Parduhn | 404/10 |
| 4,123,030 | 10/1978 | Johansson | 248/475 B X |
| 4,205,472 | 6/1980 | Shirley | 248/289.3 X |

FOREIGN PATENT DOCUMENTS

| | | | |
|---|---|---|---|
| 1237231 | 6/1960 | France | 248/289.3 |
| 125188 | 6/1945 | Sweden | 404/612 |
| 961623 | 6/1964 | United Kingdom | 248/475 B |

*Primary Examiner*—Rodney H. Bonck

*Attorney, Agent, or Firm*—Wells, St. John & Roberts

[57] ABSTRACT

An attachment that provides pivoted support for a roadway delineator on a standard roadway delineator post. The attachment makes use of the delineator post as an offset support at a position clear of the roadway, thereby avoiding damage to the post by vehicles or roadway maintenance equipment. A bracket mounts an elongated delineator support arm to the upright delineator post. The support arm extends from the post toward the roadway where, at an inner end, the standard delineator reflector is mounted. The elongated delineator support arm is pivotably mounted to the bracket so it will swing about an inclined axis in response to impact with a vehicle moving along the roadway. The pivot axis for the delineator support arm is inclined so the support arm and delineator will return to the extended position alongside the roadway after being struck. An indentation is provided on the bracket to releasably locate the delineator support arm at its extended position so the delineator reflector will not be provided from its normal extended position by normal causes such as wind.

5 Claims, 4 Drawing Figures

DELINEATOR

BACKGROUND OF THE INVENTION

The present invention is related to highway delineators that will deflect or pivot upon impact with a vehicle moving along an adjacent roadway.

Large numbers of highway markers (delineators) are positioned at spaced intervals along paved highways to indicate the roadway shoulders in darkness and adverse conditions. A delineator is typically formed of a circular reflecting disk mounted to an upright metal channel. The channel is driven into the ground or is set in a concrete footing. Highway delineators are normally situated closely adjacent to the shoulder of the roadway. They are therefore easily struck and damaged or destroyed by passing vehicles. Repair crews then have to pull or cut off the damaged post, have them straightened or replaced, and replace the delineator reflector. This is obviously an expensive task, not only in materials, but in manhours.

It becomes desirable to provide some form of highway delineator attachment that can make use of existing delineator mounting posts. It is also desirable to pivotably support the delineator reflector so that the post can be relocated away from the roadway shoulder.

One solution to the problem of damaged highway delineators was recognized by Alfred Parduhn who invented an articulated highway delineator post and was issued U.S. Pat. No. 4,032,248 therefor. The Parduhn post is articulated at the base of a delineator post assembly by a resilient tubular sleeve that mounts the post to the ground. Forceable impact with the post will cause deflection of the post in the direction of impact. Subsequently, the resilient tubular base will lift the delineator post back to its normal, upright position.

The Parduhn delineator post may be somewhat effective in preventing damage to the delineator post and to the impacting vehicle. However, after several impacts, it is a probability that the post and its flexible mount will work loose from the surrounding ground surface. Additional maintenance is then required to reposition the post along the roadside. In addition, the post must be mounted closely adjacent to the roadside, and therefore presents the same obstruction to snow plows and highway roadside maintenance equipment as standard highway delineator support posts.

A. Kammerich recognized the need for having an offset pivoted mount for mailboxes and road sign supports. His U.S. Pat. No. 2,050,573 discloses a ground mounted support requires use of a "Z" shaped support arm structure for the sign or mailbox. The weight of the support arm in addition to the cantilevered weight of the mailbox or sign at the outward end of the support arm requires that the entire support unit be set in a concrete footing. However, the sign or mailbox, upon being struck by a vehicle or other moving objects, will swing away from the roadway and will subsequently swing back into its transverse position to the roadway due to gravity.

DETAILED DESCRIPTION OF A PREFERRED EMBODIMENT

Figure 1:
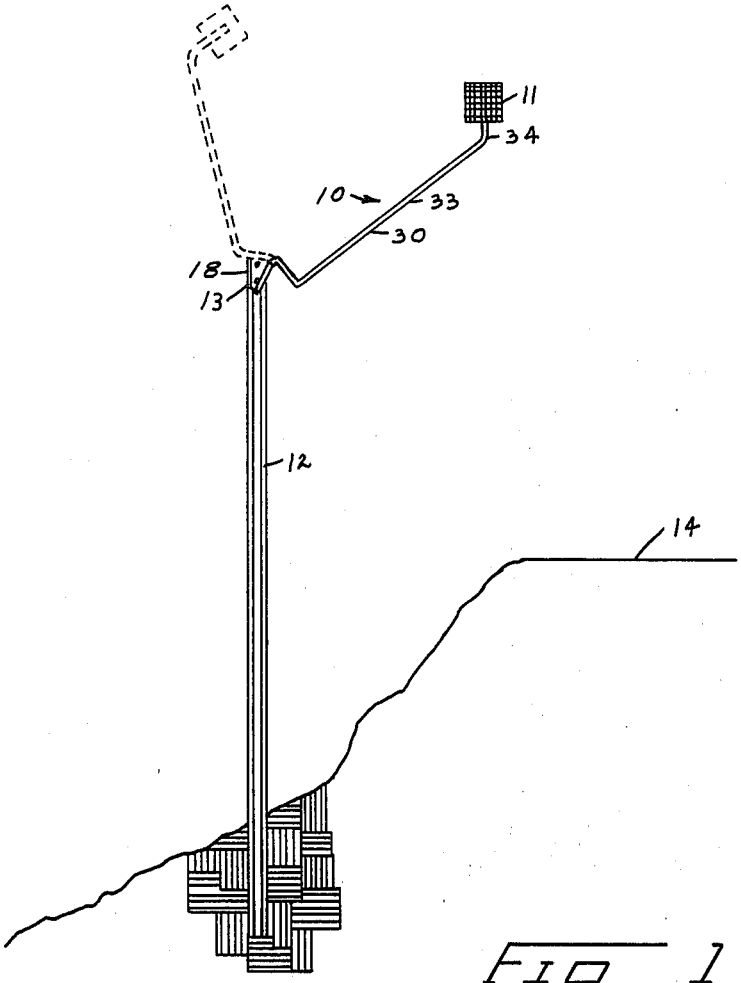
FIG. 1 is an elevational view of the present attachment showing its position in relation to a roadway surface.

The present attachment is shown generally in the accompanying drawings by the reference character 10. The present attachment 10 is intended to mount a delineator reflector 11 at a position laterally offset from a delineator post 12 in relation to a roadway 14.

The delineator post 12, as shown, is a standard upright metal post used typically to mount highway delineator reflectors 11. The delineator post 12 may include a top end 13 spaced above the ground surface a predetermined distance. A bottom end of the post is either driven into the ground alongside the roadway or may be more permanently positioned in a concrete footing.

The present attachment 10 may be mounted to the standard delineator post 12 so that the post need not be replaced. However, it is recommended that the post 12 be repositioned in relation to the roadway 14. Repositioning may be accomplished simply by pulling the post from the ground and reinserting it at a spaced location from the roadway. The post 12 will not ordinarily be permanently anchored in concrete because impact forces are not transmitted directly to the delineator post 12.

The present attachment includes a bracket 18 pivotably mounting an elongated delineator support arm 30. An outward end of the delineator support arm removably mounts the delineator reflector 11.

The bracket 18 is formed of a flat metal plate, having an integral socket 19 provided along one side thereof. The socket 19 is formed by rolling an edge of the plate material back onto itself to form an upright, inclined bore. The bore extends between a top socket end 20 and bottom end 21.

Figure 3:
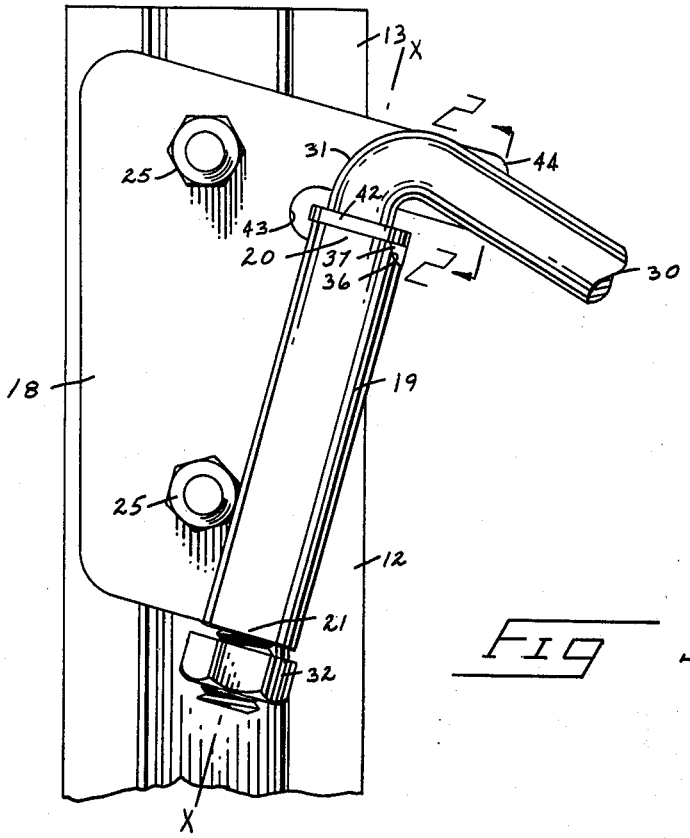
FIG. 3 is an enlarged fragmentary view illustrating the bracket and a portion of the delineator support arm.
Figure 4:
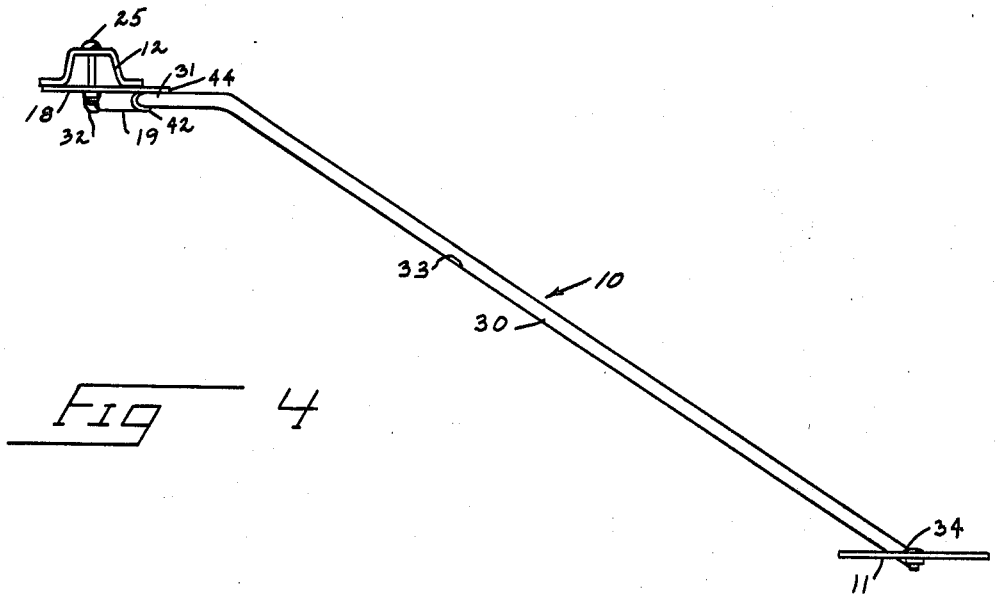
FIG. 4 is a plan view of the present attachment mounted to a delineator post.

The socket bore defines an inclined delineator pivot axis that is designated at X—X in FIG. 3. This axis X—X is intended to be situated in a vertical plane and inclined toward the roadway 14 when the bracket is affixed to the delineator post 12. In addition, the axis X—X lies within a vertical plane that is perpendicular to the roadway 14.

Means is provided for mounting the bracket 18 to the delineator post 12. Such means may be screws or bolts 25 extending through appropriate holes in bracket 18. The screws or bolts 25 will also extend through appropriate holes in the post 12. Free ends of the screws or bolts will receive nuts or the holes can be threaded to allow the bracket to be clamped securely by the screws or bolts against the delineator post 12. The holes are arranged in relation to the post so that the delineator pivot axis X—X is inclined as described above.

Figure 2:
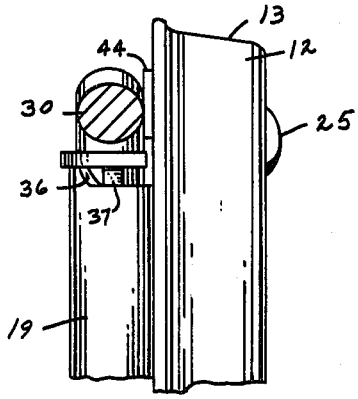
FIG. 2 is an enlarged sectional view taken substantially along line 2—2 in FIG. 3.

The delineator support arm is clearly shown in FIGS. 1 and 3. A fragment of the inward end of the delineator is shown in some detail in FIGS. 2 and 3. The delineator support arm 30 includes an inclined inner end 31. This end 31 is intended to be pivotably received through the length of the socket 19. The delineator support arm 30 is formed of rod material having a cross-sectional diameter only slightly less than the corresponding inside diameter of the socket bore. The delineator support arm 30 is free to pivot about delineator support arm axis X—X.

The inclined inner end 31 of support arm 30 is headed at 32. This headed end may be comprised of an enlargement of the inner end 31 or may simply be a nut 32 threadably engaging the arm end. The nut or headed end 32 should be somewhat larger in dimension than the inside diameter of the socket bore. The support arm 30 cannot therefore be easily removed unintentionally or by vandals. To assure this, an appropriate locking mechanism (not shown) may be provided to secure the arm in place on the bracket 18.

The delineator support arm extends outwardly from the inclined inner end 30 to an intermediate portion 33 and on to an outside end 34. The intermediate portion of the support arm 30 is bent adjacent the inclined inner end 31. The bend is downward as shown in FIG. 1 and in the direction of traffic along the roadway as shown in FIG. 3.

The angular relationship of the intermediate portion shown in FIG. 3 is of some importance. The acute angle formed by the intermediate portion 33 with the roadway 14 is such that any vehicle will strike the support arm or delineator with a glancing blow, causing pivotal movement of the delineator support arm from the operative full line position of FIG. 1 to the dashed line position. This angular offset of the arm assures that impact forces will not be directly transmitted to the delineator post 12.

The outside end 34 of the delineator support arm 30 is upturned and is substantially vertical when the attachment is mounted to a delineator post 12. The upturned end 34 includes one or more holes adapted to mount the standard delineator 11. The distance from the inclined inner end 31 to the outside end 34 may vary, but is preferably approximately 24 inches. This allows for a 24 inch offset transversely from the original position of the delineator post 12. The post can therefore be located clear of vehicles traveling along the roadway to allow access to the shoulder for purposes of roadway maintenance and plowing.

Means is provided for releasably positioning the delineator support arm 30 in the preferred, substantially transverse orientation to the highway 14 as shown in FIG. 3. Such means may include an indentation 36 formed within the socket 19 at the top end 20 thereof. The indentation 36 is shown in substantial detail by FIG. 3. Indentation 36 is angularly positioned in relation to the delineator pivot axis X—X along the otherwise substantially planar top surface of the socket 19. A complementary dog 37 of the delineator support arm 30 is received within the indentation 36 when the arm is pivoted to its normal operative position. The dog 37 fits into the indentation 36 and is held there by the weight of the support arm 30. The indentation 36 and complementary dog 37 of the support arm are designed so that the weight of the support arm will hold the mating parts in position until force in excess of normal wind velocity is directed against the delineator 11 or the support arm 30.

A shoulder 42 is provided directly upward adjacent the indentation 36 and dog 37 of the support arm to cover the socket 19. The shoulder 42 is preferably affixed to the support arm. The shoulder covers the socket 19 to prevent formation of ice or collection of dust between the inner arm end 31 and the socket 19. The shoulder 42 pivots with the arm 30 within a slot 43 formed in the bracket.

A stop 44 is formed integrally with the bracket 18 and extends outwardly into the path of the delineator support arm 30. The stop 44 is positioned to prevent undesired pivotal movement of the support arm past the operative transverse position shown in FIG. 3 and by solid lines in FIG. 1.

Prior to installation of the present attachment, the delineator post 12 is removed from its original roadside position to a position spaced laterally from the roadway 14 a distance substantially equal to the length of the delineator support arm. The post is then redriven in an upright orientation so that its top 13 is set a prescribed height above the ground surface.

The bracket 18 may be mounted to the delineator post 12 subsequent to removing of the post from its original position or after it has been reset at the desired distance from the roadway. The bracket is mounted by using existing delineator mounting aperatures as the mounting holes 27 that can be aligned with the holes 26 of the mounting bracket. If appropriate holes are not found along the top end of the post 12, additional holes may be drilled on location. The holes on the post are located so that the delineator pivot axis X—X will be inclined toward the roadway and lies within the vertical plane perpendicular to the roadway. The bracket is then mounted by the appropriate screws and bolts 25 and is secured to the post 12.

The delineator support arm 30 is mounted to the bracket by inserting the inclined inner end 31 through the socket bore. The bottom end of the inner end 31 is then fitted with a nut or other appropriate headed end 32 to lock the supporting arm 30 in pivotal engagement with the bracket 18.

Finally, as a last step to installation, the delineator 11 that was previously used on the post 12 can be remounted to the outside end 34 of the pivoted delineator support arm 30. This is done through use of the conventional threaded shaft and nut arrangement provided on the delineator.

Care is taken during initial placement of the delineator post 12 and mounting of the bracket 18 to the post so the indentation 36 and corresponding dog 37 of the delineator support arm is set within a prescribed angular relationship to the axis X—X and roadbed 14. This relationship must be such that the delineator support arm will pivot by gravity normally to a position wherein the indentation 36 receives the dog 37 but will allow disengagement of the part when sufficient impact is made in the preferred direction of road travel against the delineator or support arm.

The height of the delineator 11 from the roadbed 14 may be adjusted simply by bending the delineator support rod 30 up or downwardly. Therefore, slight variations in the height of the delineator post 12 above the ground surface can be allowed.

In operation, the delineator support arm will provide pivoted support for the delineator adjacent the road surface until the delineator 11 or support arm is struck by a vehicle moving in the prescribed direction for that side of the roadway 14. As this happens, the impact of the force is directed as a moment arm about the axis X—X and results in pivotal movement of the delineator and delineator support arm toward the inoperative dashed line position of FIG. 1. The impact energy is dissipated during the upward swing of the arm and delineator. Very little, if any, of the impact force is absorbed by the delineator post 12.

Following impact, the delineator and support arm are free to pivot back to the operative position by gravity, due to the inclined relationship of the socket 19 to the ground and the cantilevered orientation of the delineator. The indentation 36 will again receive the dog 37 of support arm 30 as the support arm reaches its operative position. Since energy of the impact has been absorbed by pivoted movement of the delineator support arm, bending of the support arm or damage to the delineator post 12 will not occur. Both the indentation 36 and the stop 44 function to releasably secure the support arm in its operative position after return from the deflected, inoperative position.

The above description and attached drawings are given by way of example to set forth a preferred form of my invention. The scope of the present invention is more fully defined in the attached claims.

What I claim is:

1. An attachment for an upright highway delineator post having an upper delineator supporting end adapted to project above the ground surface to support a delineator and a bottom end adapted to be anchored to the ground alongside a roadway, said attachment comprising:

a bracket having a mounting surface thereon adapted to engage the post;

a socket on the bracket defining a delineator pivot axis;

mounting means adapted to secure the bracket to the post at a selected elevation adjacent the upper end thereof so the delineator pivot axis is inclined toward the roadway from the post;

an elongated delineator support arm having (a) an inclined inner end received by the socket for pivotal movement about the delineator pivot axis, (b) an intermediate, substantially horizontal portion extending outwardly of the delineator pivot axis, and (c) an outside arm adapted to mount a delineator;

a gravity biased, axial detent means on the support arm inner end and socket for releasably locating the delineator support arm at a prescribed angular position relative to said pivot axis, said detent including mating parts normally held in interlocking engagement by the weight of the support arm and capable of releasing by shifting the arm inner end axially along the delineator pivot axis, in response to lateral forces on the arm in excess of normal wind velocity; and stop means on the bracket extending outwardly into the pivot path of the delineator support arm to engage and prevent undesired pivotal movement of the delineator support arm past said prescribed angular position.

2. The attachment as defined by claim 1 wherein the support arm is bent at its intermediate portion so the arm will extend inwardly toward the roadway and forwardly with the direction of traffic along the roadway.

3. The attachment as defined by claim 1 wherein the socket includes an open ended bore for receiving the inclined inner end of the delineator support arm and wherein the inclined end of the delineator support arm projects through the socket to a lower headed end, said headed end being larger than the socket bore.

4. The attachment as defined by claim 1 further comprising shoulder means on the delineator support arm adjacent the inclined inner end thereof and slidably engaging and covering the socket at a top end thereof.

5. The attachment as defined by claim 1 wherein the socket and bracket are integral.

* * * * *